US007485588B2

(12) United States Patent
Wang et al.

(10) Patent No.: US 7,485,588 B2
(45) **Date of Patent: *Feb. 3, 2009**

(54) METHOD FOR MAKING TEXTILE SUBSTRATES HAVING LAYERED FINISH STRUCTURE FOR IMPROVING LIQUID REPELLENCY AND STAIN RELEASE

(76) Inventors: Yunzhang Wang, 526 Forest Shoals La., Duncan, SC (US) 29334; Daike Wang, 380 Woodsberry Shoals Dr., Duncan, SC (US) 29334; Simon X. Zhang, 241 Independence La., Peachtree City, GA (US) 30269

( * ) Notice: Subject to any disclaimer, the term of this patent is extended or adjusted under 35 U.S.C. 154(b) by 692 days.

This patent is subject to a terminal disclaimer.

(21) Appl. No.: 11/145,337

(22) Filed: Jun. 3, 2005

(65) Prior Publication Data

US 2005/0272333 A1 Dec. 8, 2005

(51) Int. Cl.

| | |
|---|---|
| ***B32B 27/04*** | (2006.01) |
| ***B32B 5/02*** | (2006.01) |
| ***B05D 5/00*** | (2006.01) |
| ***B05D 1/02*** | (2006.01) |
| ***B05D 1/28*** | (2006.01) |
| ***B05D 3/04*** | (2006.01) |

(52) U.S. Cl. ..... 442/93; 427/315; 427/381; 427/394; 427/412; 427/421.1; 427/428.01; 442/65; 442/66; 442/68; 442/94

(58) Field of Classification Search ..... 427/314, 427/315, 372.2, 377, 379, 381, 394, 412, 427/421.1, 428.01; 428/190, 365; 442/65, 442/66, 68, 93, 94

See application file for complete search history.

(56) References Cited

U.S. PATENT DOCUMENTS

| | | | |
|---|---|---|---|
| 3,372,039 | A | 3/1968 | Gagliardi |
| 3,597,145 | A | 8/1971 | Marco |
| 3,598,514 | A | 8/1971 | Sello et al. |
| 3,598,515 | A | 8/1971 | Moore et al. |
| 3,645,990 | A | 2/1972 | Raynolds |
| RE28,914 | E | 7/1976 | Marco |
| 4,007,305 | A | 2/1977 | Kakar et al. |
| 4,043,964 | A | 8/1977 | Sherman et al. |
| 4,193,880 | A | 3/1980 | Marshall |
| 4,540,497 | A | 9/1985 | Chang et al. |
| 4,624,889 | A | 11/1986 | Bries |
| 4,668,406 | A | 5/1987 | Chang |
| 4,668,726 | A | 5/1987 | Howells |
| 4,695,488 | A | 9/1987 | Hisamoto et al. |
| 4,748,267 | A | 5/1988 | Chang |
| 4,861,501 | A | 8/1989 | Pfeifer |
| 4,958,039 | A | 9/1990 | Pechhold |
| 5,258,458 | A | 11/1993 | Allewaert et al. |
| 5,410,073 | A | 4/1995 | Kirchner |
| 5,411,766 | A | 5/1995 | Kirchner |
| 5,508,370 | A | 4/1996 | Reiff |
| 5,509,939 | A | 4/1996 | Kirchner |
| 5,565,265 | A | 10/1996 | Rubin et al. |
| 5,580,645 | A | 12/1996 | Kirchner |
| 5,614,123 | A | 3/1997 | Kubo et al. |
| 5,672,651 | A | 9/1997 | Smith |
| 5,693,737 | A | 12/1997 | Reiff |
| 5,714,082 | A | 2/1998 | Boardman et al. |
| 5,747,392 | A | 5/1998 | Xiao et al. |
| 5,843,328 | A | 12/1998 | Pacifici et al. |
| 5,899,783 | A | 5/1999 | Kimbrell, Jr. et al. |
| 5,948,480 | A | 9/1999 | Murphy |
| 6,024,823 | A | 2/2000 | Rubin et al. |
| 6,043,209 | A | 3/2000 | Micciche et al. |
| 6,080,830 | A | 6/2000 | Dirschl |
| 6,136,730 | A | 10/2000 | Kimbrell, Jr. et al. |
| 6,162,369 | A | 12/2000 | Allewaert et al. |
| 6,197,378 | B1 | 3/2001 | Clark et al. |
| 6,207,250 | B1 | 3/2001 | Bullock et al. |
| 6,224,782 | B1 | 5/2001 | Allewaert et al. |

(Continued)

FOREIGN PATENT DOCUMENTS

| | | |
|---|---|---|
| FR | 2805288 | 8/2001 |
| WO | WO 2005/035858 | 4/2005 |

OTHER PUBLICATIONS

Wash Durable, Liquid Repellent, and Stain Releasing Cotton Fabric Substrates.

Substrates Having Reversibly Adaptable Surface Energy Properties and Method for Making Same; Kimbrell et al.; U.S. Appl. No. 10/340.300, filed Jan. 10, 2003; Our Case No. 5472 (claims enclosed).

Wash Durable, Liquid Repellent, and Stain Releasing Polyester Fabric Substrates.

Material Safety Data Sheet for Zonyl® 7713 from Ciba Specialty Chemicals Corporation, pp. 1-7.

(Continued)

*Primary Examiner*—William Phillip Fletcher, III
(74) *Attorney, Agent, or Firm*—Brenda D. Wentz

(57) ABSTRACT

This invention relates to textile substrates to which a finishing treatment has been applied during the manufacturing process. Such a finishing treatment provides improved water and/or oil repellency and stain and soil resistance. The finishing treatment generally includes a repellent agent, a stain release agent, and a particulate component. Other compounds may be added to the treatment, such as stain-blocking agents, crosslinking agents, coupling agents, antimicrobial agents, and pH adjusting agents. The components of the finishing treatment are generally applied to the textile substrate using an application process that results in layered structures on the surface of the treated substrate, which has been found to greatly improve the durability of the treatment. Such treated textile substrates thus exhibit excellent stain and soil resistance and water and/or oil repellency properties.

22 Claims, 1 Drawing Sheet

U.S. PATENT DOCUMENTS

| | | | |
|---|---|---|---|
| 6,239,247 | B1 | 5/2001 | Allewaert et al. |
| 6,309,752 | B1 | 10/2001 | Dams et al. |
| 6,340,719 | B1 | 1/2002 | Goeb et al. |
| 6,387,999 | B1 | 5/2002 | Dirchl et al. |
| 6,485,789 | B1 | 11/2002 | Allewaert et al. |
| 6,525,127 | B1 | 2/2003 | Jariwala et al. |
| 6,899,923 | B2 | 5/2005 | Kimbrell |
| 2002/0052457 | A1 | 5/2002 | Fitzgerald |
| 2003/0001130 | A1 | 1/2003 | Qiu |
| 2004/0018787 | A1 * | 1/2004 | Bullock et al. ..... 442/59 |
| 2005/0095933 | A1 | 5/2005 | Kimbrell |

OTHER PUBLICATIONS

Technical Data Sheet for Zony® 7713 from Ciba Specialty Chemicals Corporation, pp. 1-7.

International Search Report. PCT/US2006/020802 Date of mailing Dec. 14, 2006.

* cited by examiner

METHOD FOR MAKING TEXTILE SUBSTRATES HAVING LAYERED FINISH STRUCTURE FOR IMPROVING LIQUID REPELLENCY AND STAIN RELEASE

FIELD OF THE INVENTION

This invention relates to textile substrates to which a finishing treatment has been applied during the manufacturing process. Such a finishing treatment provides improved water and/or oil repellency and stain and soil resistance. The finishing treatment generally includes a repellent agent, a stain release agent, and a particulate component. Other compounds may be added to the treatment, such as stain-blocking agents, crosslinking agents, coupling agents, antimicrobial agents, and pH adjusting agents. The components of the finishing treatment are generally applied to the textile substrate using an application process that results in layered structures on the surface of the treated substrate, which has been found to greatly improve the durability of the treatment. Such treated textile substrates thus exhibit excellent stain and soil resistance and water and/or oil repellency properties. Furthermore, it has been found that application of such a finishing treatment to the textile substrates is durable and provides improved cleanability to the treated substrates.

BACKGROUND OF THE INVENTION

All U.S. Patents and Patent Applications disclosed herein are entirely incorporated by reference.

It has long been a necessity, particularly within the textile industry, to provide substrates that exhibit a number of simultaneous wash or abrasion durable properties. Most notably, water repellency, oil repellency, stain resistance, and stain release characteristics are highly desirable to facilitate cleaning of substrates, if not to prevent complete staining thereof. Unfortunately, provision of such simultaneous and wash or abrasion durable characteristics has been severely limited due to the general difficulties with meeting certain surface energy requirements throughout the wash or abrasion durable life of such a substrate. Generally, coatings or other treatments have not been readily available or widely known that can provide coexistent water and oil repellency and stain release on a wash durable basis to textile substrates (or other surfaces) because the surface energy profile required for one of these properties is disparately different from the surface energy profile required to impart the other property at the same time.

Although there have been some instances of initial simultaneous existence of both properties on certain substrates (as noted below), unfortunately, the degree of wash-durability thereof has been unacceptable for long-term utilization of target substrates. As a result, any significant reduction in either oil or water repellency consequently reduces stain repellency as well. With a reduced propensity to repel stains, the ability to effectuate proper stain release may likewise be diminished, particularly upon exposure to greater degrees of staining and wherein the surface energy profile needed for proper stain release function (which is similar to that needed to impart the aforementioned water and oil repellency properties) is compromised (e.g., is not wash or abrasion durable).

Hence, truly effective wash or abrasion durable, long-term, stain repellent, stain release, and soil resistant treatments have not been forthcoming, since simultaneous prevention of both polar (aqueous) and non-polar (olefinic) liquid penetration into such textile substrate surfaces has been very difficult to achieve that can withstand multiple wash and/or abrasion cycles. Market and consumer demands have shown that it would be desirable to render various textile substrates resistant to staining by as many common staining materials as possible and simultaneously render the substrates with improved stain removal characteristics by using routine cleaning procedures appropriate for the substrates. These cleaning procedures may include washing, such as in a home or industrial laundering machine, or spot cleaning procedures, such as used for upholstery. In addition, various other routine cleaning procedures, such as those employed for carpet cleaning and dry cleaning, are contemplated.

As one non-limiting example of a textile substrate, floorcovering articles, particularly the pile portion of such articles (e.g., the portion which is designed to be in contact with pedestrians' footwear, such as tufted fibers, cut pile fibers, loop pile fibers, and the like), are highly susceptible to staining, dirt accumulation, liquid spills, and the like. With pedestrians walking on such surfaces, it has been extremely challenging for floorcovering manufacturers to provide floorcovering articles that resist such attacks and maintain their original appearance after long-term use. Attempts by others to provide finishing treatments to floorcovering articles have included applying fluorochemical compounds to the surface of the article, for example, by spray coating. However, because the fluorochemical compounds applied in this manner appear to remain on the top and outside of the yarn bundles comprising a carpeted floorcovering article, rather than penetrating into the yarn bundle, such a process typically fails to provide the desired level of water and oil repellency. Furthermore, fluorochemical compounds applied in this fashion are easily worn off and thus, fail to provide the desired level of durability.

Thus, it is an object of the present invention to provide a finishing treatment for a textile substrate which provides long-term, durable stain and soil resistance and water and/or oil repellency to the treated substrate. Such durability is achieved, for example, after exposure of the textile substrate to 10000 cycles of ASTM D4966-98 Martindale Abrasion. It is also an object of the present invention to provide a process for applying the finishing treatment to the textile substrate, wherein the process provides a treated substrate that exhibits durable stain and soil resistance and water and/or oil repellency.

DESCRIPTION OF THE INVENTION

Definitions

Figure 1:
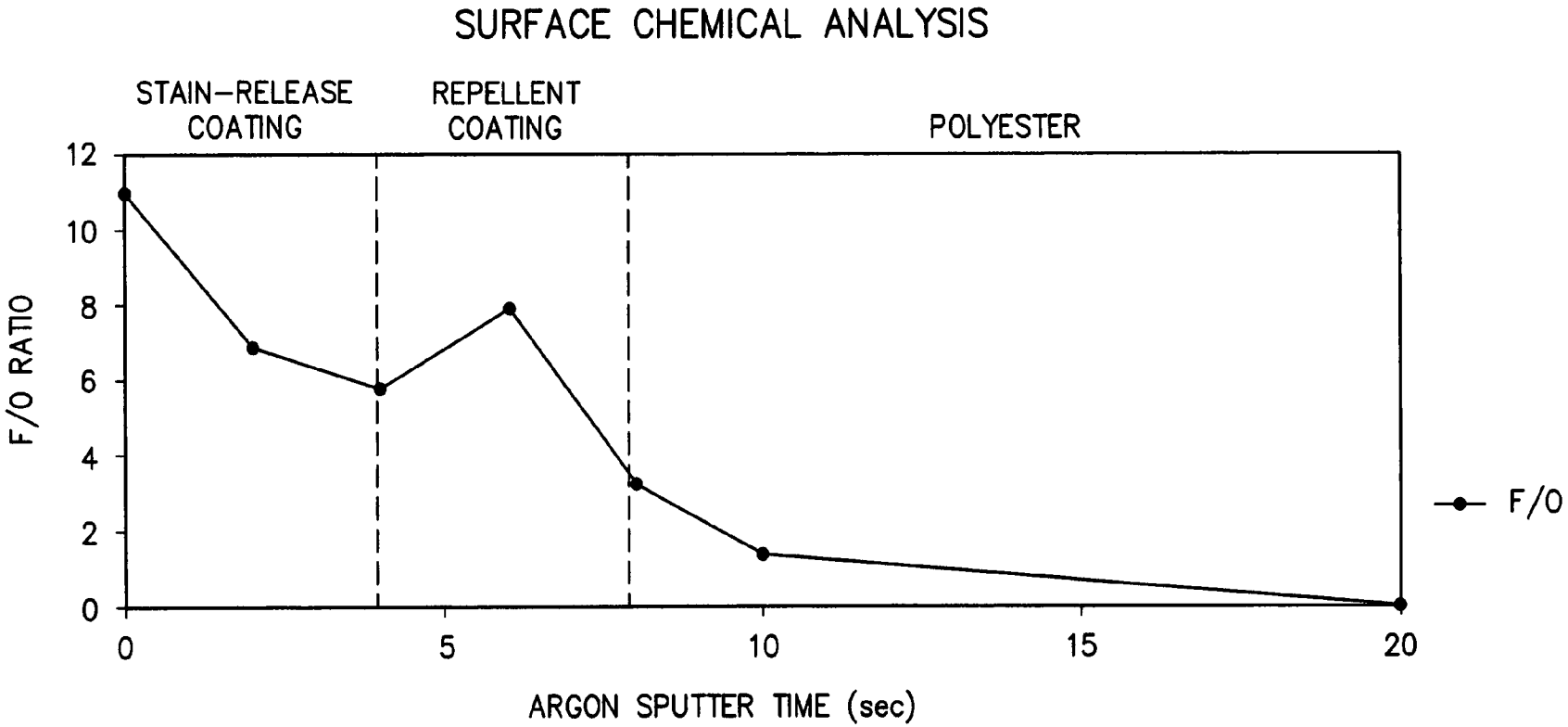
FIG. 1 is a graphical representation of the ratio of fluorine to oxygen as determined by X-ray Photoelectron Spectroscopy (XPS) analysis on treated polyester fabric.

The terms "fluorochemicals", "fluorocarbons", and "fluoropolymers" may be used interchangeably and each represents polymeric materials containing at least one fluorinated segment, preferably containing —$CF_3$ groups. The specific definitions of the terms are given below.

"Fluorochemical" generally refers to an organic compound in which some or all of the hydrogen atoms directly attached to the carbon atoms have been replaced by fluorine.

"Fluorocarbon" generally refers to a class of organic compounds, similar to hydrocarbons, in which fluorine atoms replace some or all of the hydrogen atoms.

"Fluoropolymer" generally refers to a polymer composed of linear repeating units in which some or all of the hydrogen atoms are replaced with fluorine.

"Hydrophilic" is generally defined as having a strong affinity for or the ability to absorb water.

"Hydrophobic" is generally defined as lacking affinity for or the ability to absorb water.

"Water repellency" and "oil repellency" are generally defined as the ability of a substrate to block water and oil, respectively, from penetrating into the substrate. For example, the substrate may be a textile substrate which is capable of blocking water and oil from penetrating into the fibers of the textile substrate. As defined herein, a water repellent agent typically refers to a compound that, when applied to a textile substrate, provides a water repellency rating of at least 1.0 when tested by the 3M Water Repellency Test II (May 1992). A water and oil repellent agent typically refers to a compound that, when applied to a textile substrate, provides a water repellency rating of at least 1.0 when tested by the 3M Water Repellency Test II (May 1992) and an oil repellency rating of at least 1.0 when tested by AATCC Test Method 118-2000.

"Stain release" is generally defined as the degree to which a stained textile substrate approaches its original, unstained appearance as a result of a care procedure. As defined herein, high levels of stain resistance means an oil repellency rating of at least 3.0 when tested by AATCC Test Method 118-2000, a water repellency rating of at least 3.0 when tested by the 3M Water Repellency Test II (May, 1992), and a spray rating of at least 50 when tested by AATCC Test Method 22-2000. Acceptable stain release, as described herein, means a rating for corn oil and mineral oil release of at least 3.0 when tested by modified AATCC Test Method 130-2000.

The term "padding" describes an application process used for application of the finishing treatment to the textile substrate. It generally refers to a process wherein a liquid coating is applied to a textile substrate by passing the substrate through a bath and subsequently through squeeze rollers.

The term "floorcovering article," as used herein, is intended to describe a textile substrate which comprises face fibers and which are utilized to cover surfaces on which people are prone to walk. Thus, carpets (broadloom, tile, or otherwise) and floor mats (outdoor, indoor, and the like) are specific types of floorcovering articles.

The term "face fiber portion" encompasses any standard fibers and composites thereof, which are utilized within floorcovering articles. The face fiber portion may be comprised of monofilament fiber, core-sheath fiber, and the like, or may be present as loop pile, cut pile, or any other type of carpet face. As mere examples, nylon, polyethylene, polypropylene, polyester, cotton, polyvinylacetate, and the like, fibers may be tufted through a fabric (such as a woven, non-woven, or knit fabric of any fiber type, such as those listed previously). This fabric segment is generally referred to as the primary backing portion of a floorcovering article.

The term "layered structure" is intended to describe a structure formed on a textile substrate to which a multi-component finish (i.e. at least two components) has been applied. Two or more components of the multi-component finish, instead of being entirely intermixed together, are substantially separate from each other in a layered arrangement, thus forming a layered structure. The boundary between the layers may be distinct or they may be intermixed.

Textile Substrate

Textile substrates of the current invention may be of any known construction including a knit construction, a woven construction, a nonwoven construction, and the like, or combinations thereof. Textile substrates may have a weight of between about 1 and about 55 ounces/square yard. Textile substrates such as fabrics may more preferably have a weight of between about 2 and about 12 ounces/square yard, whereas textile substrates such as floorcovering articles may more preferably have a weight of between about 20 and about 50 ounces/square yard.

The material of the textile substrate can be synthetic fiber, natural fiber, man-made fiber using natural constituents, inorganic fiber, glass fiber, or a blend of any of the foregoing. By way of example only, synthetic fibers may include polyester, acrylic, polyamide, polyolefin, polyaramid, polyurethane, or blends thereof. More specifically, polyester may include polyethylene terephthalate, polytrimethylene terephthalate, polybutylene terephthalate, polylactic acid, or combinations thereof. Polyamide may include nylon 6, nylon 6,6, or combinations thereof. Polyolefin may include polypropylene, polyethylene, or combinations thereof. Polyaramid may include poly-p-phenyleneteraphthalamide (i.e., Kevlar®), poly-m-phenyleneteraphthalamide (i.e., Nomex®), or combinations thereof. Exemplary natural fibers include wool, cotton, linen, ramie, jute, flax, silk, hemp, or blends thereof. Exemplary man-made materials using natural constituents include regenerated cellulose (i.e., rayon), lyocell, or blends thereof.

The textile substrate may be formed from staple fiber, filament fiber, slit film fiber, or combinations thereof. The fiber may be exposed to one or more texturing processes. The fiber may then be spun or otherwise combined into yarns, for example, by ring spinning, open-end spinning, air jet spinning, vortex spinning, or combinations thereof. Accordingly, the textile substrate will generally be comprised of interlaced fibers, interlaced yarns, loops, or combinations thereof.

The textile substrate may be comprised of fibers or yarns of any size, including microdenier fibers or yarns (fibers or yarns having less than one denier per filament). The fibers or yarns may have deniers that range from less than about 0.1 denier per filament to about 2000 denier per filament or, more preferably, from less than about 1 denier per filament to about 500 denier per filament.

Furthermore, the textile substrate may be partially or wholly comprised of multi-component or bi-component fibers or yarns in various configurations such as, for example, islands-in-the-sea, core and sheath, side-by-side, or pie configurations. Depending on the configuration of the bi-component or multi-component fibers or yarns, the fibers or yarns may be splittable along their length by chemical or mechanical action.

Additionally, the fibers comprising the textile substrate may include additives coextruded therein, may be precoated with any number of different materials, including those listed in greater detail below, and/or may be dyed or colored to provide other aesthetic features for the end user with any type of colorant, such as, for example, poly(oxyalkylenated) colorants, as well as pigments, dyes, tints, and the like. Other additives may also be present on and/or within the target fiber or yarn, including antistatic agents, brightening compounds, nucleating agents, antioxidants, UV stabilizers, fillers, permanent press finishes, softeners, lubricants, curing accelerators, and the like.

The textile substrate may be printed or dyed, for example, to create aesthetically pleasing decorative designs on the substrate or to print informational messages on the substrate. The textile substrate may be colored by a variety of dyeing and/or printing techniques, such as high temperature jet dyeing with disperse dyes, thermosol dyeing, pad dyeing, transfer printing, screen printing, digital printing, ink jet printing, flexographic printing, or any other technique that is common in the art for comparable, equivalent, traditional textile products. In addition, the fibers or yarns comprising the textile substrate of the current invention may be dyed by suitable methods prior to substrate formation, such as for instance, via package dyeing, solution dyeing, or beam dyeing, or they may be left undyed. In one embodiment, the textile substrate may be printed with solvent-based dyes rather than water based dyes.

It is also contemplated that a textile substrate composite material may be formed by combining one or more layers of textile substrate together. For example, it may be desirable to combine several layers of an open weave textile substrate together to form a textile substrate composite material. The composite material may also include adhesive material or one or more layers of film. The composite material may then be treated with the chemical composition of the present invention to achieve a material that exhibits durable stain repellency and stain release performance characteristics. Alternatively, in yet another embodiment of the invention, the textile substrates comprising the composite material may be treated with the chemical composition before being combined into a composite material.

For embodiments in which the textile substrate is a floorcovering article, any standard carpet yarn or fiber may be utilized as the substrate for topical treatment thereof within this application. Thus, natural (cotton, wool, and the like) or synthetic fibers (polyesters, polyamides, polyolefins, and the like) may constitute the target substrate, either by itself or in any combinations or mixtures of synthetics, naturals, or blends or both types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, as well as homopolymers, copolymers, or terpolymers in any combination of such monomers, and the like, may be utilized within this invention. As one potentially preferred fiber type, polyamide fibers are commonly used to create floorcovering articles because of their strength, flexibility, toughness, elasticity, abrasion resistance, washability, ease of drying, and resistance to attack by microorganisms.

The floorcovering articles may be manufactured according to a variety of standard processes known to those skilled in the art. Generally, prior to integration with any other components, the face fiber portion is sewn, tufted, needled, and the like, through the primary backing fabric to form a composite which can then be simply adhered to a further portion. Alternatively, the primary backing fabric may be contacted with a secondary backing fabric and the face fiber portion may then be created by needling, etc., through the primary backing fabric. Examples of carpet and carpet tile production are disclosed within U.S. Pat. No. 5,929,145 to Higgins et al.; U.S. Pat. No. 5,948,500 to Higgins et al.; U.S. Pat. No. 5,545,276 to Higgins et al.; and U.S. Pat. No. 5,540,968 to Higgins et al. Examples of floor mat production are present within U.S. Pat. No. 5,902,662 to Kerr; U.S. Pat. No. 5,928,446 to Kerr et al.; and U.S. Pat. No. 5,305,565 to Nagahama et al.

Finishing Treatment

The finishing treatment useful for rendering a textile substrate with improved stain and soil resistance and water and/or oil repellency is typically comprised of a repellent agent, a stain release agent and a particulate component. It has been unexpectedly discovered that superior water and oil repellency and stain release is achieved when the finishing treatment is applied using a process comprising at least two steps such that the components of the finishing treatment are layered on the textile substrate. Generally, these unexpected results are achieved by applying a first layer of chemicals comprising a repellent agent to the textile substrate and then subsequently applying a second layer of chemicals to the first layer. The second layer of chemicals includes a stain release agent or both a repellent agent and a stain release agent. A particulate component may be added to the chemical mixture of either the first layer, the second layer, or both layers. It is believed that these results are unexpected because one having ordinary skill in the art would not expect that after application of a water and oil repellent layer to a textile substrate that one could then add a stain-releasing layer of chemistry that would adhere to this first repellent layer and would not compromise the repellent properties of the first repellent layer. However, it has been found, through the use of certain processing steps, that such an arrangement can be achieved and that the resulting treated substrate exhibits improved repellency, stain release, and soil resistance characteristics.

Other optional additives may be included in the treatment in order to impart various desirable attributes to the textile substrate. These include, without limitation, stain-blocking agents, crosslinking agents, coupling agents, antimicrobial agents, and pH adjusting agents. Chemical components may be optimized to achieve the desired level of performance for different target applications within a single finishing treatment. Further, the relative ratio of each component to the other components may vary depending upon the target application.

Repellent Agents:

Water repellent agents typically include waxes, silicones, certain hydrophobic resins, and the like, or combinations thereof. Compounds which generally provide both water and oil repellency to a textile substrate include fluorochemicals.

Generally, repellent fluorochemicals useful in the present invention include any of the fluorochemical compounds and polymers known in the art to impart dry soil resistance and water- and oil-repellency to fibrous substrates. These repellent fluorochemical compounds and polymers typically comprise one or more fluorochemical radicals that contain a perfluorinated carbon chain having from about 3 to about 20 carbon atoms, more preferably from about 6 to about 14 carbon atoms. These fluorochemical radicals can contain straight chain, branched chain, or cyclic fluorinated allcylene groups, or any combination thereof. The fluorochemical radicals are preferably free of polymerizable olefinic unsaturation but can optionally contain catenary heteroatoms such as oxygen, divalent or hexavalent sulfur, or nitrogen. Fully fluorinated radicals are preferred, but hydrogen or chlorine atoms may also be present as substituents, although, preferably, no more than one atom of either is present for every two carbon atoms. It is additionally preferred that any fluorochemical radical contain from about 40% to about 80% fluorine by weight, and more preferably, from about 50% to about 78% fluorine by weight. The terminal portion of the radical is preferably fully fluorinated, preferably containing at least 7 fluorine atoms, e.g., $CF_3CF_2\ CF_2$—, $(CF_3)_2CF$—, and $CF_5\ CF_2$—. Perfluorinated aliphatic groups (i.e., those of the formula $C_nF_{2n+1}$—) are the most preferred fluorochemical radical embodiments.

Representative repellent fluorochemical compounds useful in finishing treatment of the present invention include, without limitation, fluorochemical urethanes, ureas, esters, ethers, alcohols, epoxides, allophanates, amides, amines (and salts thereof), acids (and salts thereof), carbodiimides, guanidines, oxazolidinones, isocyanurates, and biurets.

Blends of these compounds are also considered useful. Representative fluorochemical polymers useful in treatments in the present invention include fluorochemical acrylate and substituted acrylate homopolymers or copolymers containing fluorochemical acrylate monomers interpolymerized with monomers free of non-vinylic fluorine such as methyl methacrylate, butyl acrylate, acrylate and methacrylate esters of oxyalkylene and polyoxyalkylene polyol oligomers (e.g., oxyethylene glycol dimethacrylate, polyoxyethylene glycol dimethacrylate, methoxy acrylate, and polyoxyethylene acrylate), glycidyl methacrylate, ethylene, butadiene, styrene, isoprene, chloroprene, vinyl acetate, vinyl chloride, vinylidene chloride, vinylidene fluoride, acrylonitrile, vinyl chloroacetate, vinylpyridine, vinyl alkyl ethers, vinyl alkyl ketones, acrylic acid, methacrylic acid, 2-hydroxyethylacrylate, N-methylolacrylamide, 2-(N,N,N-trimethylammonium)ethyl methacrylate, and 2-acrylamido-2-methylpropanesulfonic acid (AMPS). The relative amounts of various non-vinylic fluorine-free comonomers used are generally selected empirically depending on the textile substrate to be treated, the properties desired, and the mode of application onto the textile substrate. Useful fluorochemical treatments also include blends of the various repellent fluorochemical polymers described above as well as blends of the aforementioned fluorochemical compounds with these repellent fluorochemical polymers.

Commercially available examples of water and oil repellent fluorochemicals that can be used in conjunction with the current invention include, but are not limited to, the Scotchgard™ family of repellent fluorochemicals by 3M, the Zonyl™ family of repellent fluorochemicals by Dupont, the Repearl™ family of repellent fluorochemicals by Mitsubishi International Corporation. Repearl® F-8025, Repearl F-7105, and Repearl F-7000 by Mitsubishi are particularly useful in the practice of the current invention. Other fluorochemicals, such as the Unidyne™ products distributed by Daikin America, Inc. or products distributed by OMNOVA Solutions may also be employed. Fluorochemical based water and oil repellent agents may be preferred for use in the present invention.

Stain Release Agents:

A stain release agent is generally a compound that assists in the release of stains that are present on, or are present within, a textile substrate that has been treated with a stain release agent. The stain release agent may be a fluorochemical based compound, or it may be non-fluorochemical based compound.

Fluorochemical based stain release agents generally comprise fluorinated stain release fluoropolymers. Many of these types of stain release agents are hybrid polymeric materials that have oleophobic and hydrophilic moieties combined in a copolymer so that the respective moieties have mobility under various conditions of temperature and environment. The chemistry of these materials is taught in numerous patents, for example, U.S. Pat. No. 3,574,791 to Sherman et al. and U.S. Pat. No. 3,944,527 to McCown. Exemplary oleophobic fluorochemical parts of the hybrid polymeric material are described in these patents.

The hydrophilic groups include, but are not limited to, alkoxylates, especially ethoxylates; and carboxyl, hydroxyl, sulfonate, sulfate, phosphate and phosphonate groups. Examples of commercially available fluorochemical based stain release component are Unidyne® TG-992 and Unidyne®TG-993, both available from Daikin Corp., Repearl® SR1100, available from Mitsubishi Corp., as well as Zonyl® 7910, available from DuPont.

Examples of non-fluorochemical based stain release agents include ethoxylated polyesters, sulfonated polyesters, ethoxylated nylons, carboxylated acrylics, cellulose ethers or esters, hydrolyzed polymaleic anhydride polymers, polyvinylalcohol polymers, polyacrylamide polymers, ethoxylated silicone polymers, polyoxyethylene polymers, polyoxyethylene-polyoxypropylene copolymers, and the like, or combinations thereof.

In another embodiment, the stain release agent may be a blend of a non-fluorochemical based hydrophilic agent and a fluorochemical repellent agent as described above and as taught in commonly owned U.S. Pat. No. 6,818,253 to Kimbrell. Fluorochemical based stain release agents may be preferred stain release agents. Fluorochemical based stain release agents comprised of hybrid oleophobic and hydrophilic moieties may be most preferred.

Particulate Component:

Various particulate materials, inorganic or organic, may be used in conjunction with the present invention. Without being bound by theory, it is believed that the particulate component increases the repellency of the textile substrate and may even act synergistically with a repellent agent to improve repellency upon application of both materials to a textile substrate. It is also believed that the particulate component may also provide other functions to the treated textile substrate, such as soil resistance, ultraviolet stability, abrasion resistance, etc.

Preferably, the particles are comprised of at least one material selected from the group consisting of silicates, doped silicates, minerals, silicas, polymers, carbon, graphite, metal salts, metal powders, silica-coated metal powders, inorganic oxides (such as metal oxides), and the like, and combinations thereof. More specifically, examples of particles that may be employed include, but are not limited to, silica, colloidal silica, alumina, zirconia, titania, zinc oxide, precipitated calcium carbonate, polytetrafluoroethylene (PTFE), perfluorinated copolymers, copolymers with tetrafluoroethylene, polyvinylpyrrolidone (PVP), and the like. Such particles can also be surface modified, for instance by grafting.

The size of the selected particles should be taken into consideration for several reasons. Particles that are too small may not provide appropriate surface roughness to trap air on the substrate surface or may require high loading with subsequent agglomeration to achieve the desired effect. Particles that are too large may give a frosty, white appearance to dyed textiles or may be removed easily during use or routine maintenance of the textile substrate. In general, particle sizes of between about 1 nm and about 50 μm are believed to be capable of providing good results in various applications of the invention. Particle sizes in the range of between about 5 nm and about 1 μm are particularly useful, and particle sizes in the range of between about 10 nm and about 50 nm have been found to work well in some applications.

As used herein, the terms "inorganic oxide" or "metal oxide" refer to a general class of materials comprising at least one species of metal cation combined with oxygen anions or hydroxyl anions, or mixtures of oxygen and hydroxyl ions. This material can additionally contain water in bound or adsorbed form and can further comprise small amounts, for example less than 5% by weight, stabilized counter ions such as sodium ion, carboxylate ion, chloride ion, nitrate ion, or the like. For the purposes of the present invention, it is usually desirable that the metal oxides or inorganic oxides be in a very finely divided state. Colloidal dispersions provide a particularly useful form for use in the present invention.

The following may be utilized in the practice of the present invention, depending upon the specific application to be employed:

Nalco 1042™ Colloidal Silica—a 34% solids (by weight) aqueous colloidal acidic silica sol cation available commercially from Nalco Chemical Co. ("Nalco"), Naperville, Ill.

Nalco 1050™ Colloidal Silica—a 50% by weight solids aqueous colloidal silica sol available commercially from Nalco. The sol has a pH of 9, an average particle size of 20 nm in diameter;

Nalco 2326™ Colloidal Silica—a 15% by weight solids aqueous colloidal silica sol available commercially from Nalco. The sol has a pH of 9, an average particle size of 5 nm in diameter;

Nalco 2327™ Colloidal Silica—a 40% by weight solids aqueous colloidal silica sol available commercially from Nalco. The sol has a pH of 9, an average particle size of 20 nm in diameter.

Nalco 2329™ Colloidal Silica—a 40% by weight solids aqueous colloidal silica sol available commercially from Nalco. The sol has a pH of 9, an average particle size of 75 nm in diameter;

Nalco 1056™ Aluminized Silica—a 30% by weight solids aqueous colloidal suspension of aluminized silica particles (26% silica and 4% alumina) available commercially from Nalco;

Nalco 88SN-126™ Colloidal Titanium Dioxide—a 10% by weight solids aqueous dispersion of titanium dioxide available commercially from Nalco;

Nalco 88SN-123™ Colloidal Tin Oxide—a 22% by weight solids aqueous dispersion of tin oxide available commercially from Nalco;

Cab-O-Sperse S3295™ Fumed Silica—a 15% by weight solids aqueous dispersion of fumed silica available commercially from Cabot Corporation of Boyertown, Pa. The dispersion has a pH of 9.5, and an average agglomerated primary particle size of about 100 nm in diameter;

Cab-O-Sperse A205™ Fumed Silica—a 15% by weight solids aqueous dispersion of fumed silica available commercially from Cabot Corporation of Boyertown, Pa. The dispersion has an average particle size of about 100 nm in diameter;

Ludox® AS 40 Colloidal Silica—a 40% by weight solids aqueous colloidal silica sol available commercially from Grace Davison, Columbia, Md. The sol has a pH of 9, an average particle size of 22 nm in diameter;

Ludox® μM Colloidal Silica—a 30% by weight solids aqueous sol, available from Grace Davison. The sol has a pH of 9, an average particle size of 12 nm in diameter;

Ludox® CL-P Colloidal Alumina Coated Silica—a 40% by weight solids aqueous sol, available from Grace Davison. The sol has a pH of 4, an average particle size of 22 nm in diameter;

Ludox® CL Colloidal Alumina Coated Silica—a 30% by weight solids aqueous sol, available from Grace Davison. The sol has a pH of 4.5, an average particle size of 12 nm in diameter;

Ludox® TMA Colloidal Silica—a 34% by weight solids aqueous colloidal silica sol, available from Grace Davison. The sol has a pH of 4.7 and an average particle size of 22 nm in diameter;

Ludox SM Colloidal Silica—a 30% by weight solids aqueous dispersion available from Grace Davison. It has an average particle size of about 20 nm in diameter;

Aerosil® R7200 Hydrophobic Fumed Silica available from Degussa Corporation of Germany. The material has an average pH of 5.5 and an average particle size of approximately 12 nm in diameter;

Aeroxide® Alu C Hydrophilic Fumed Alumina Oxide available from Degussa Corporation of Germany. The material has an average pH of 5 and an average particle size of 13 nm in diameter;

Sipernat® 22LS Hydrophilic Precipitated Silica-dry powder available from Degussa Corporation of Germany. The average aggregated particle size is 4.5 μm in diameter;

Sipernat® 500LS Hydrophilic Precipitated Silica—dry powder available from Degussa Corporation of Germany. The average aggregated particle size is 4.5 μm in diameter; and Viviprint 540™ poly(vinylpolypyrrolidone) particles with 10% by weight solids from ISP Technologies.

In some cases, particles having other functional properties may be used. Such particles may provide additional attributes beyond the structural building feature described herein. For example, AlphaSan® antimicrobial particles, available from Milliken & Company of Spartanburg, S.C., may provide antimicrobial features to the textile substrate. Zinc oxide particles may offer odor-absorbing properties. Zelec™ particles, also available from Milliken & Company, may provide antistatic properties. Zinc borate particles or antimony pentoxide may provide flame retardant and fungicide properties. Iron-based microparticles may provide magnetic and microwave-absorbing properties.

Stain-Blocking Agents:

One class of stain-blocking agents suitable for this invention includes anionic surfactants having a relatively low molecular weight (MW in the range of 500 to 50,000) and containing sulfonic groups that react with nylon under low pH conditions. Examples of suitable stain-blocking agents are sold by Minnesota Mining and Manufacturing Company (3M) of St. Paul, Minn., under the tradename Stainblocker FC661 and by Milliken & Company of Spartanburg, S.C., under the tradenames FS2 and FS7.

Crosslinking Agents:

Various types of crosslinking agents may be suitable for incorporation into the finishing treatment of the present invention. One group of crosslinking agents includes hydrophobic crosslinking agents. Hydrophobic crosslinking agents include those crosslinking agents which are insoluble in water. More specifically, hydrophobic crosslinking agents may include monomers containing blocked isocyanates (such as blocked diisocyanates), polymers containing blocked isocyanates (such as blocked diisocyanates), epoxy containing compounds, and the like, or combinations thereof. Diisocyanate containing monomers or diisocyanate containing polymers may be the preferred crosslinking agents. However, monomers or polymers containing two or more blocked isocyanate compounds may be the most preferred crosslinking agents. One potentially preferred crosslinking agent is Repearl® MF, also available from Mitsubishi Corp. Others include Arkophob® DAN, available from Clariant, Epi-Rez® 5003 W55, available from Shell, and Hydrophobol® XAN, available from Dupont, and Milliguard® MRX, available from Milliken & Company.

Coupling Agents:

Coupling agents are generally used to provide a stable bond between organic polymer compounds and inorganic materials, which would otherwise be incompatible. One non-limiting class of coupling agents includes silane-containing coupling agents. Silane coupling agents are a class of organofunctional silanes that have the generic structure: Y—R—Si—$X_3$, where X is a hydrolysable group such as methoxy, ethoxy, or acetoxy, and Y is an organofunctional group attached to silicon by an alkyl bridge, R. Examples of the Y groups are vinyl, epoxy, amino, ureido, mercapto, methacrylate, and the like. Silane coupling agents are generally used for coupling inorganic particulate materials to organic resins. Once the hydrolysable X groups hydrolyze in the presence of moisture and condense onto the surface of the inorganic particulate materials, the Y component then allows for reaction to a variety of resin systems.

Examples of commercially available silane coupling agents include the Silquest® A-series of silanes available from GE silicones-OSi Specialties and the Dow Corning Z-series of silanes available from Dow Corning.

Other Additives:

In many instances, for a textile substrate to perform satisfactorily, regardless of its end-use application, attributes other than durable stain and soil resistance, stain release, and repellency are desirable. Examples of such attributes include static protection, wrinkle resistance, shrinkage reduction or elimination, desirable hand (or feel) requirements, dyefastness requirements, odor control, flammability requirements, and the like.

Accordingly, it may be desirable to treat the textile substrate with finishes containing chemicals such as antimicrobial agents, antibacterial agents, antifungal agents, flame retardants, UV inhibitors, antioxidants, coloring agents, lubricants, thickeners, durable press resins (such as dimethyloldihydroxyethyleneurea), other types of resins (such as Kymene 450), catalysts (such as Catalyst 531), antistatic agents, fragrances, and the like, or combinations thereof. Furthermore, antimicrobial and/or antifungal agents may be utilized in order to inhibit microbial and/or fungal growth and even to help control odor. Examples of antimicrobial and/or antifungal agents include colloidal silver; AlphaSan® RC-5000 and AlphaSan® RC-2000 (both available from Milliken & Company); Ultrafresh NM, Ultrafresh DM-50, and Ultrafresh DM-25 (all available from Thompson Associates); Chitosante (available from VAG Bioscience); Kathon LM (available from Rohm and Haas); Reputex (available from Avecia); AM 5700 (available from Dow Corning); Amical 48 (available from Dow Chemical); zinc omadine (available from Arch Chemicals, Inc.); and combinations thereof. Potentially preferred are the AlphaSan® antimicrobial products and zinc omadine.

Many such chemical treatments can be incorporated simultaneously with the finishing treatment of the current invention, or such treatments may be carried out prior to treatment with the chemical composition of the current invention. It is also possible, using appropriate techniques, to apply many such chemical treatments after application of the finishing treatment of the current invention.

Additionally, the textile substrate may also be treated by mechanical finishing techniques. For example, it may be desirable to expose the textile substrate to mechanical treatment such as calendering, embossing, etching, rainbow or hologram embossing, film or metal foil hologram embossing, fabric metallization, heat setting, hydroentanglement with water or air, sanforizing, glazing, schreinering, sueding, sanding, emorizing, napping, shearing, tigering, decating, fabric patterning through the use of water, air, laser, or patterned rolls, and the like, or combinations thereof. These mechanical treatments typically provide desirable effects to the textile substrate which affect such properties as the appearance, strength, and/or hand of the fabric. Depending on which mechanical treatment is utilized, advantages may be obtained by treatment either before or after the finishing treatment of the current invention is applied. By way of example, benefits from sanding prior to application of the finishing treatment and calendaring after application of the finishing treatment may be envisioned.

Additionally, and particularly for floorcovering articles which have pile surfaces, other additives and conditioning agents may be included in the finishing treatment. These include, without limitation, bleach resistance agents, color safe agents, foaming agents, and the like. Such bleach resistant formulations are preferably aqueous in nature (although short-chain alcohols, such as methanol, ethanol, isopropanol, and the like, may also be utilized as the solvent therein) and may be in the form of a shampoo, coating, spray, atomized dispersion, and the like. Foaming agents may include any of various anionic or nonionic surfactants, including, without limitation, fatty aryl-sulfonates, -phosphates (preferably dodecylbenzenesulfonic acid), ethoxylated fatty alcohols (preferably Syn Lube® 728 from Milliken & Company), coconut oil, and the like, and mixtures thereof.

The total amount of the finishing treatment applied to the textile substrate, as well as the proportions of each of the chemical agents comprising the finishing treatment, may vary over a wide range. The total amount of finishing treatment applied to the textile substrate will depend generally on the composition of the article, the level of durability required for a given end-use application, and the cost of the chemical composition. As a general guideline, the total amount of chemical solids applied to the textile substrate will be found in the range of about 0.25% to about 10.0% on weight of the textile substrate. More preferably, the total amount of chemical solids applied to the substrate may be found in the range of about 0.5% to about 5.0% on weight of the substrate. Typical solids proportions and concentration ratios of repellent agent to stain release agent may be found in the range of about 10:1 and about 1:10, including all proportions and ratios that may be found within this range. Preferably, solids proportions and concentration ratios of repellent agent to stain release agent may be found in the range of about 5:1 and about 1:5. The total amount of particulate component applied to the textile substrate is preferably less than about 10% on weight of the textile substrate.

If it is desirable that a crosslinking agent is added to the composition, the ratio of repellent agent to stain release agent to crosslinking agent may be found in the range of about 10:1:0.1 and about 1:10:5, including all proportions and ratios that may be found within this range. Preferably, solids proportions and concentration ratios of repellent agent to stain release agent to particulate component may be found in the range of about 5:1:0.1 and about 1:5:2.

The proportion of repellent agent to stain release agent and the amount of particulate component applied to the textile substrate may likewise be varied based on the relative importance of each property being modified. For example, higher levels of repellency may be required for a given end-use application. As a result, the amount of repellency agent, relative to the amount of stain release agent, may be increased. Alternatively, higher levels of stain release may be deemed more important than high levels of stain repellency. In this instance, the amount of stain release agent may be increased, relative to the amount of stain repellency agent. The amount of particulate component may be adjusted accordingly.

For the purpose of producing a more economical finishing treatment, the type of repellent agent, stain release agent, and particulate component may be varied based on the end-use of the treated textile substrate. For example, a treated floorcovering article may be produced that is not expected to encounter oil based stains. Accordingly, more economical repellency agents, such as silicones, may be utilized as one component of the finishing treatment.

Method For Applying the Finishing Treatment

Application of the finishing treatment to the textile substrate may be accomplished by a variety of application methods which include, without limitation, spraying, foaming, padding, steaming, or by any other technique whereby one can apply a controlled amount of a liquid suspension to a textile substrate. Employing one or more of these application techniques may allow the finishing treatment to be applied to the textile substrate in a uniform manner.

The finishing treatment is generally applied to the textile substrate using a multi-layered application process. The first step of the process involves the application of a first chemical composition comprising a repellent agent to the substrate. This method of application generally results in the first chemical layer being proximal to or contiguous with the surface of the textile substrate. This structural layering effect is demonstrated in FIG. 1.

The textile substrate may then be exposed to a controlled drying step, in order to evaporate the desired amount of liquid from the substrate leaving the solid active components on the surface of the treated substrate. Drying can be accomplished by any technique typically used in manufacturing operations, such as dry heat from a tenter frame, microwave energy, infrared heating, steam, superheated steam, autoclaving, or the like, or any combination thereof. Alternatively, the textile substrate may not be exposed to a drying step in which case, the substrate will generally remain wet for step two of the application process.

The second step of the process involves the application of a second chemical composition comprising a stain release agent or both a repellent agent and a stain release agent. The repellent agent may be the same or it may be different from the repellent agent applied in the first step of the application process. The second chemical composition may be applied simultaneously with or sequentially to the first chemical layer, for example, by spraying, foaming, or padding techniques. This method of application generally results in the second chemical layer being proximal to or contiguous with the first chemical layer on the surface of the textile substrate. This structural layering effect is demonstrated in FIG. 1.

After application of the finishing treatment to the textile substrate, the treated substrate is generally exposed to a drying step to evaporate excess liquid, leaving the solid active components on the surface of the treated substrate. Additionally, it may be desirable to expose the treated substrate to an additional heating step to further enhance the performance or durability of the chemical agents. This step may be referred to as a curing step. By way of example, additional heating may (a) enable certain discreet particles of the active components of the chemical agents to melt-flow together, resulting in uniform, cohesive film layers; (b) induce preferred alignment of certain segments of the chemical agents; (c) induce crosslinking reactions between the chemical agents or between the chemical agents and the substrate; or (d) combinations thereof.

DESCRIPTION OF THE PREFERRED EMBODIMENTS

Various embodiments of the invention are shown by way of the Examples below, but the scope of the invention is not limited by the specific Examples provided herein.

Test Methods a) 3M Water Repellency Test II (May, 1992)

Water repellency for fabric textile substrates was tested according to the 3M Water Repellency Test II (May, 1992). The rating scale is 0-10, with "0" indicating the poorest degree of repellency (substrates having higher surface energy) and "10" indicating the best degree of repellency (substrates having lower surface energy). The 3M Water Repellency Test scale is:

0 is 0% Isopropanol (IPA), 100% water (by weight)
1 is 10% IPA, 90% water
2 is 20% IPA, 80% water
3 is 30% IPA, 70% water
4 is 40% IPA, 60% water
5 is 50% IPA, 50% water
6 is 60% IPA, 40% water
7 is 70% IPA, 30% water
8 is 80% IPA, 20% water
9 is 90% IPA, 10% water
10 is 100% IPA A test sample was placed on a flat, horizontal surface. 3 small drops of the test liquid, approximately 5 mm in diameter, were placed gently in three different areas on the test sample using a dropper or pipette. The drops were allowed to stand undisturbed for 10 seconds. If after 10 seconds, two of the three drops are still visible as spherical to hemispherical, the sample passes the test. The reported water repellency rating corresponds to the highest IPA containing blend for which the treated substrate passes the test.

b) 3M Water Repellency Test V (February, 1994)

Water repellency for floorcovering textile substrates was tested according to the 3M Water Repellency Test V (February, 1994). The rating scale of 0-10 is the same as that described in "a" above with regard to water repellency for fabric textile substrates. The reported water repellency rating corresponds to the highest IPA-containing blend that resulted in a pass designation for the treated floorcovering substrate.

c) Oil Repellency Test—AATCC Test Method 118-2000

Oil Repellency for fabric textile substrates was tested according to the AATCC (American Association of Textile Chemists and Colorists) Test Method 118-2000. The rating scale is 0-8, with "0" indicating the poorest degree of repellency (substrates having higher surface energy) and "8" indicating the best degree of repellency (substrates having lower surface energy). The oil repellency scale is:

0 is Nujol™ Mineral Oil (the substrate wets with the oil)
1 is Nujol™ Mineral Oil
2 is 65/35 Nujol/n-hexadecane (by volume)
3 is n-hexadecane
4 is n-tetradecane
5 is n-dodecane
6 is n-decane
7 is n-octane
8 is n-heptane A test sample was placed on a flat, horizontal surface. Beginning with the lowest numbered test liquid, a small drop of the test liquid, approximately 5 mm in diameter, was placed gently in several different areas on the test sample using a dropper or pipette. The drops were allowed to stand undisturbed for 30 seconds and observe the drop at a 45° angle. If after 30 seconds, no penetration or wetting of the sample substrate at the liquid-substrate interface and no wicking around the drop occurs, the sample passes the test. The numerical Oil Repellency Rating given to the sample is the highest numbered test liquid which will not wet the substrate within a period of 30 seconds.

d) Oil Repellency Test—Modified AATCC Test Method 118-2000

Oil repellency for floorcovering articles which have pile surfaces is the same as that described above in "c" for fabric textile substrates, except for the following modifications:

Prior to placing the drops of testing liquid on the surface of the article, brush the pile with the back of your hand to the direction of greatest pile lay.

After placing 5 drops of testing liquid on the surface of the article, observe the drops for 10 seconds (rather than 30 seconds as described above) at a 45 degree angle. Repeat this step until obvious wetting of the article occurs within the 10 second time period.

e) Spray Rating Test—AATCC Test Method 22-2000

The Spray Rating Test was conducted in accordance with AATCC Test Method 22-2000. The rating scale is as follows:

100—No sticking or wetting of upper surface
90—Slight random sticking or wetting of upper surface
80—Wetting of upper surface at spray points
70—Partial wetting of whole of upper surface
50—Complete wetting of whole of upper surface
0—Complete wetting of whole upper and lower surfaces.

f) Martindale Abrasion Test—ASTM D4966-98

The Martindale Abrasion Test was performed according to ASTM D4966-98 modified using a Mark III Abrasion Tester BS5690 (Shirley Developments Ltd.). A 7 inch×7 inch sample was mounted onto the test station. A woven wool fabric, which was placed on the abrasion cylinder (with a 12 kpa weight), was used as the abrasive material. The sample was then exposed to a pre-determined number of abrasion cycles.

g) Stain Release Test—Modified AATCC Method 130-2000

The Stain Release Test procedure used here is a modification of AATCC Method 130-2000 such that a spot removal method was used to clean the stains instead of a laundering process. Stains such as corn oil (CO), burned motor oil (BMO), ketchup, mustard are applied to a test fabric according to the AATCC Method 130. The stained fabric was set aside for 24 hours at 70+/−2 degrees F. and 65+/−2% RH before cleaning. The following procedures were used to spot clean the stains:

1. Place the stained specimen on a smooth horizontal surface.
2. Using an ArmorAll cleaning Wipe, lightly wipe the stain 5 times from the outside of the stain toward the center.
3. For each wipe pass, use a clean section of ArmorAll cleaning wipe.
4. Start timer. Continue wiping the stain using an outside in motion. Apply pressure when wiping the stain, but do not apply so much pressure as to damage the substrate material.
5. Continue wiping for 1 minute.
6. Place 4 paper towels over the stained area of the test specimen.
7. Place the weight on top of the paper towel directly over the cleaned area.
8. Leave weight on top of stain for 1 minute. Repeat steps 6, 7, and 8.
9. Allow specimen to dry at 70+/−2 degrees F. and 65+/−2% RH for 24 hours.

The residual stains were evaluated according to the AATCC Method 130-2000.

h) Dry Soil Resistance Test—AATCC Test Method 123-2000

This test method describes a procedure for the accelerated soiling of carpets. It can be used to compare the soiling propensity of two or more carpets, or it can be used to soil carpets as a preliminary step in measuring either the ability of a carpet to be cleaned or the efficiency of a cleaning process. This accelerated carpet soiling method has been found to give results similar to floor service soiling, but its use is recommended only as a screening method and not as a replacement for floor testing.

Specimens of carpet are tumbled together with prepared synthetic soil in a laboratory ball mill for a predetermined time. The synthetic soil (available from Textile Innovators) is composed of the following components: 38% peat moss, 17% kaolin, 17% portland cement, 17% silica, 1.75% carbon black, 0.5% red iron oxide, 8.75% mineral oil (medical grade).

Soiling levels are predetermined on an arbitrarily selected carpet (control sample) soiled to give light, medium and heavy degrees of soil preferably by exposure to a service soiling test (5.0 grams of soil was used for each test). Soiling times in the ball mill are determined by soiling unsoiled specimens of the control sample to match the levels of soiling established with soiled control specimens. The carpet specimens under evaluation are soiled for 1 minute.

The soiling procedure is as follows:

(1) Place two samples in the mill jar with the back of each sample against the inside cylindrical surface of the jar;
(2) Place 5 g of soil on the face of the carpet samples as uniformly as possible;
(3) Add 50 flint pebbles in the porcelain jar and fasten cover to jar;
(4) Rotate the jar and contents on the ball mill at 250-300 rpm; and
(5) At the end of the predetermined soiling time (1 min) remove carpet samples and clean excess soil from carpet samples by light vacuuming with the tank-type vacuum cleaner. All of the carpet samples were vacuumed until no further soil was visibly removed (approximately 30 seconds).

The carpet samples are evaluated by using an instrumental method to measure the ΔEcmc of the soiled samples. The ΔEcmc measurements are made in 3 locations on the carpet samples, and the average ΔEcmc is reported. It is recommended that AATCC Test Method 121 Carpet Soiling Visual Rating Method be used for evaluation. It may be necessary to use a visual panel evaluation if time or available equipment does not permit evaluation by AATCC Method 121.

The three L*, a*, b* color coordinates of the soiled carpet samples may be measured using a Minolta 310 Chroma Meter with a D65 illumination source. The color difference value, ΔEcmc, of each soiled carpet sample is calculated relative to its unsoiled counterpart. This ΔEcmc measurement is in accordance with industry procedures, as set forth for example in U.S. Pat. No. 5,908,663 to Wang et al. The ΔEcmc values calculated from these colorimetric measurements have been shown by others to be qualitatively in agreement with values from previously used visual evaluations such as the soiling evaluation suggested by the AATCC.

Additionally, ΔEcmc values have the additional advantages of higher precision, and they are largely unaffected by environment variations or operator subjectivities. The color shade differential is provided below as ΔEcmc, and the larger the number reported below corresponds to poor soil removal. Thus, a low ΔEcmc means that the unsoiled and soiled textile articles are closer in color shade, and therefore, more soil has been removed. From color theory, ΔEcmc will be different depending on the color or pattern of the carpet and the color or amount of the soil used. Light colors will show greater color change after soiling with a dark soil. Therefore, the value given in the specification and claims much be adjusted from the values given for white carpet, if another carpet color or pattern is evaluated.

i) Carpet Cleanability Test—AATCC Test Method 171-2000

AATCC Test Method 171-2000 was used to determine stain release for the floorcovering substrates, with the exceptions described below:

Place the test sample flat on a smooth, horizontal surface. Then 10 drops of red Kool-Aid stain are applied to the test sample and rubbed into the carpet for 30 seconds with a circular motion of a gloved finger. The stains are allowed to dry overnight (approximately 16 hours). Use the cleaning solution of 1.0% Tide (Powder) in hot tap water (approximately 120 degrees F.) to do the hot water extraction with a Bissell Little Green Cleaner (model #1720-1). Samples are cleaned for a maximum of 2 minutes or until the stain is completely removed (less than 2 minutes). The cleaned samples are air dried and rated as follows: 5.0=complete removal, 4.0=very good removal (>75%), 3.0=good removal (>50%), 2.0=fair removal (<50%), 1.0=poor removal (<25%).

Finishing Treatment Application Procedures:

All Examples provided below were treated according to one of the following procedures and are noted accordingly.

I) One-step pad application procedure

1. A piece of fabric was immersed into a bath containing the chemical composition comprising the desired chemical agents.
2. After the fabric was completely wet, the fabric was removed from the treatment bath and run between squeeze rolls at a desired pressure to obtain a uniform pickup generally between about 30 and about 100%.
3. The fabric was pulled taut and pinned to a frame to retain the desired dimensions. The pinned fabric was either put in a Dispatch oven or run through a tenter at a temperature of between about 300 and about 380 degrees F. for between about 0.5 and 10 minutes to dry and to cure the finish.

II) Multi-layer pad/pad application procedure

1. A piece of fabric was immersed into a first bath containing the chemical composition comprising the desired chemical agents.
2. After the fabric was completely wet, the fabric was removed from the treatment bath and run between squeeze rolls at a desired pressure to obtain a uniform pickup generally between about 30 and about 100%.
3. While the fabric remains wet, partially dried, or steamed, the fabric was then immersed into a fresh second bath containing a second chemical composition comprising the desired chemical agents.
4. The fabric was then run between squeeze rolls at a desired pressure to obtain a uniform pickup.
5. The fabric was pulled taut and pinned to a frame to retain the desired dimensions. The pinned fabric was either put in a Dispatch oven or run through a tenter at a temperature of between about 300 and about 380 degrees F. for between about 0.5 and 10 minutes to dry and to cure the finish.

III) Multi-layer floorcovering application procedure includes the following steps:

1. Adjust the first chemical mix to a pH of about 2.2±0.2 using sulfamic acid;
2. Spray apply approximately 30% of the first chemical mix on weight of the carpet fibers;
3. Steam the carpet for approximately 5 minutes;
4. Wash and nip the carpet using standard techniques;
5. Spray apply approximately 30% of a second chemical mix on weight of the carpet fibers; and
6. Dry and cure the carpet at a temperature of about 300 and about 380 degrees F. for between about 0.5 and 10 minutes.

It is noted that, unless otherwise stated, all chemical percents (%) in the following examples were % by weight based on the total weight of the bath prepared, and the balance remaining, when chemical percents or grams of chemical are given, is comprised of water. In addition, the % chemical was based on the chemical as received from the manufacturer, such that if the composition contained 30% active component, then X % of this 30% composition was used.

The treated textile substrates were tested for water and oil repellency, spray rating, and stain release according to the methods described previously for the as-received samples. These test results are provided in Table 1. The treated textile substrates were also tested for water and oil repellency, spray rating, and stain release after 10000 cycles of Martindale abrasion (with 12 kpa weight). These test results are provided in Table 2. The treated floorcovering articles were tested for dry soil resistance, carpet cleanability, and water and oil repellency according to the methods described previously for floorcovering substrates.

"N/A" indicates that a given sample was not tested for a particular parameter.

EXAMPLES

Example 1

A woven 100% polyester fabric (approximately 8 oz/yd$^2$) was obtained from Milliken & Company of Spartanburg, S.C. The fabric was woven, using 2 ply 150 filament textured polyester yarns in each the warp and filling, to provide a fabric having approximately 60 ends per inch and 45 pick per inch.

The woven fabric was treated according to the multi-layer pad/pad application procedure described previously. The first chemical bath contained the following components:

2% Repearl® F-7105, a fluorinated water and oil repellent agent available from Mitsubishi Corp.; and 0.5% Milliguard® MRX, an isocyanate-containing crosslinking agent available from Milliken & Company.

The second chemical bath contained the following components:

2% Repearl® F-7105;

1% Unidyne® TG-993, a stain release fluorochemical available from Daikin Corp;

0.5% Milliguard® MRX;

0.2% Aerosil® R7200, hydrophobic fumed silica particles available from Degussa Corporation of Germany; and 0.5% AlphaSan® RC5000, a silver based antimicrobial agent available from Milliken & Company.

The squeeze roll pressures were set to achieve a total wet pick up of approximately 100%. The treated fabric was dried and cured in a tenter at 325 degrees F. for approximately 5 minutes.

Example 2

Example 1 was repeated except that the 100% woven polyester fabric was replaced by a polyester double needle bar knit fabric (approximately 12 oz/yd$^2$) obtained from Milliken & Company.

Example 3

Example 1 was repeated except that the second chemical bath contained the following components:

0.02% Silquest® A-187, a silane based coupling agent available from GE;

0.2% Sipernat® 500LS, hydrophilic precipated silica particles available from Degussa Corporation of Germany;

2% Repearl® F-7105;

1% Unidyne® TG-993;

0.5% Milliguard® MRX; and 0.5% AlphaSan® RC5000.

Example 4

Example 3 was repeated except that the 100% woven polyester fabric was replaced by a polyester double needle bar knit fabric (approximately 12 oz/yd$^2$) obtained from Milliken & Company.

Example 5

In order to demonstrate improved repellency and stain release without the addition of particulate components to the finishing treatment, a plain woven 100% polyester fabric was treated according to the multi-layer pad/pad application procedure, with the following modifications described below.

A piece of fabric was immersed into a first chemical bath containing the following chemicals:

2% Repearl F-7105

0.5% Milliguard MRX

After the fabric was completely wet, the fabric was removed from the treatment bath and run between squeeze rolls at 40 psi to obtain a uniform pickup of about 60%.

While the fabric remains wet, it was put inside a steam chamber for 3 minutes. The fabric was then immersed into a fresh second bath containing the following chemicals:

2% Unidyne TG-993

0.5% Milliguard MRX;

The fabric was again run between squeeze rolls at 40 psi and pulled taut and pinned to a frame and dried in a Dispatch oven at 350 degrees F. for 5 minutes to cure the finish.

Comparative Example 1

The 100% woven polyester fabric described in Example 1 was treated according to the one-step pad application procedure as described previously. The chemical bath contained the following components:

2% Repearl® F-7105;

1% Unidyne®TG-993;

0.5% Milliguard® MRX; and 0.5% AlphaSan® RC5000.

The squeeze roll pressures were set to achieve a wet pick up of approximately 100%. The treated fabric was dried and cured in a dispatch oven at 325 degrees F. for approximately 5 minutes.

Comparative Example 2

Comparative Example 1 was repeated except that the 100% woven polyester fabric was replaced by the polyester double needle bar knit fabric (approximately 12 oz/yd$^2$).

Comparative Example 3

The 100% woven polyester fabric described in Example 1 was treated according to the one-step pad application procedure as described previously. The chemical bath contained the following components:

2% Repearl F-7105; and 0.5% Milliguard MRX.

The squeeze roll pressures were set to achieve a wet pick up of approximately 100%. The treated fabric was dried and cured in a dispatch oven at 325 degrees F. for approximately 5 minutes.

Comparative Example 4

Comparative Example 3 was repeated except that the 100% woven polyester fabric was replaced by the polyester double needle bar knit fabric (approximately 12 oz/yd$^2$).

Comparative Example 5

The 100% woven polyester fabric used in Example 5 was treated according to the one-step pad application procedure as described previously. The chemical bath contained the following components:

2% Repearl® F-7105;

2% Unidyne® TG-993; and

1% Milliguard® MRX.

The squeeze roll pressures were set to achieve a wet pick up of approximately 60%. The treated fabric was dried and cured in a dispatch oven at 350 degrees F. for approximately 5 minutes.

TABLE 1

| | Test Results for As Received Samples | | | | | | |
|---|---|---|---|---|---|---|---|
| | Water | Oil | Spray | Stain Release | | | |
| Sample | Repellency | Repellency | Rating | CO | BMO | Ketchup | Mustard |
| Example 1 | 10 | 7 | 100 | 5 | 5 | 5 | 5 |
| Example 2 | 9 | 6 | 100 | 5 | 4.5 | 4.5 | 5 |
| Example 3 | 10 | 7 | 100 | 5 | 5 | 5 | 5 |
| Example 4 | 9 | 6 | 100 | 5 | 4.5 | 4.5 | 5 |
| Example 5 | 10 | 6 | 100 | 5 | 4 | 4.5 | 5 |
| Comparative Example 1 | 10 | 7 | 70 | 5 | 5 | 4.5 | 5 |
| Comparative Example 2 | 9 | 6 | 50 | N/A | N/A | N/A | N/A |
| Comparative Example 3 | 10 | 6.5 | 100 | 3.5 | 2 | 4 | 4 |

TABLE 1-continued

| Test Results for As Received Samples | | | | | | | |
|---|---|---|---|---|---|---|---|
| | Water | Oil | Spray | Stain Release | | | |
| Sample | Repellency | Repellency | Rating | CO | BMO | Ketchup | Mustard |
| Comparative Example 4 | 9 | 6 | 100 | 3.5 | 3 | 4 | 3.5 |
| Comparative Example 5 | 10 | 6 | 70 | 5 | 4 | 4.5 | 4.5 |

TABLE 2

| Test Results for Samples after 10000 cycles Martindale Abrasion | | | | | | | |
|---|---|---|---|---|---|---|---|
| | Water | Oil | Spray | Stain Release | | | |
| Sample | Repellency | Repellency | Rating | CO | BMO | Ketchup | Mustard |
| Example 1 | 9 | 6 | 90 | 5 | 5 | 5 | 5 |
| Example 2 | 4 | 4 | 80 | 5 | 5 | 4 | 5 |
| Example 3 | 9 | 6 | 90 | 5 | 5 | 5 | 5 |
| Example 4 | 4 | 4 | 80 | 5 | 4 | 4 | 5 |
| Comparative Example 1 | 8 | 6 | 50 | 5 | 5 | 4 | 4 |
| Comparative Example 2 | 4 | 3 | 50 | N/A | N/A | N/A | N/A |

The data in Tables 1 and 2 illustrates the advantage of applying the finishing treatment using a multi-layer application process. Table 1 clearly shows that improved repellency and stain release is unexpectedly achieved by applying a first layer comprised of a repellent agent followed by a second layer comprised of a repellent agent and a stain release agent. The results in Table 2 show that the finishing treatment is durable to abrasion.

Example 6

In order to demonstrate the formation of layered structures on the textile substrate, the polyester fabric used in Example 5 and Comparative Example 5 was treated according to the multi-layer pad/pad application procedure, with the following modifications described below.

A piece of fabric was immersed into a first chemical bath containing the following chemicals:

2% Repearl F-7105

0.5% Milliguard MRX

After the fabric was completely wet, the fabric was removed from the treatment bath and run between squeeze rolls at 40 psi to obtain a uniform pickup of about 60%.

While the fabric remains wet, it was put inside a steam chamber for 3 minutes. The fabric was then immersed into a fresh second bath containing the following chemicals:

2% Unidyne TG-993

0.5% Milliguard MRX;

The fabric was again run between squeeze rolls at 40 psi and pulled taut and pinned to a frame and dried in a Dispatch oven at 350 degrees F. for 5 minutes to cure the finish.

To demonstrate the formation of layered structures in the finishing treatment, the depth profile of surface chemical analysis for fluorine (F) and oxygen (O) was performed on the treated fabric using a sputter-profile X-ray photoelectron spectroscopy (XPS). A Surface Science Laboratories, Inc. SSX-100 X-ray photoelectron spectrometer with an Al Kα X-ray source (1486.6 eV) was used for the sputter-profile XPS analysis. The base pressure was lower than $10^{-8}$ Torr. Argon ion sputtering was used to etch away the surface during profiling. The Kratos Mini-Beam II ion gun was operated at 4 keV in an argon pressure of $3.7\times10^{-7}$ Torr. The fluorine to oxygen (F/O) ratio as a function of Argon ion sputtering time is shown in FIG. 1.

The sputter-profile XPS analysis clearly demonstrates the formation of layered structure in the surface treatment. The F/O ratio is high at the very outer surface of the treated fabric due to the existence of a large number of —CF3 groups that are present in the second chemical layer, which is comprised of the stain release agent. The F/O ratio decreases as the profile analysis moves from the outer surface of the treated fabric inward to the second chemical layer. This decrease is believed to be due to the existence of ethylene oxide segments in the stain release agent. The F/O ratio begins to increase again at the interface between the second chemical layer and the first chemical layer, which is comprised of the repellent agent. The F/O ratio continues to increase as the profile analysis moves through the second chemical layer. This increase is believed to be due to the lack of ethylene oxide segments in the repellent agent. The F/O ratio diminishes as the polyester fiber is reached.

Example 7

An 18 inch by 18 inch piece of white broadloom carpet comprised of nylon 6,6 fiber and having a cut pile construction and a weight of 32 ounces per square yard was obtained from Milliken & Company. The carpet was treated according to the multi-layer floorcovering application procedure described above using the chemical agents listed below.

First Chemical Mix (Step #2):

5% FC661, a stain-blocking agent commercially available as "3M Brand Stain Release Concentrate" which contains a 29.5% aqueous solution comprising a blend of sulfonated novalak and acrylic resins; and 1.0% BK96, a repellent agent available from Milliken & Company.

Second Chemical Mix (Step #5):

1.0% BK96;

1% Ludox SM, a colloidal silica available from Grace Davison; and 0.5% Milliguard DXG, a hydrophilic fluorinated stain release agent available from Milliken & Company comprised of approximately 30% fluoroakyl acrylate copolymer solids.

The carpet was dried at a temperature of 350 F in zone 1 and 320 F in zone 2 of the range for a total of approximately 5 minutes. The face fiber portion of the carpet was then sheared using a shearing machine.

The Dry Soil Resistance Rating ΔEcmc of the treated carpet is 24.16. The ΔEcmc for the untreated white control is 40.14. The carpet cleanability of the treated carpet is 5.0. The water repellency and oil repellency ratings of the treated carpet are 4.0 and 4.0, respectively.

Comparative Example 7

The same carpet as described in Example 7 was treated according to the multi-layer floorcovering application procedure described above, except that no BK96 repellent agent was added in the first chemical mix described in step #2 of the application procedure and 2.0% of BK96 was added in the second chemical mix.

The Dry Soil Resistance Rating ΔEcmc of the treated carpet is 25.37. The ΔEcmc for the untreated white control is 40.14. The Carpet Cleanability of the treated carpet is 5.0. The Water Repellency and Oil Repellency ratings of the treated carpet are 2.0 and 3.0, respectively.

Thus, the test results for Example 7 and Comparative Example 7 illustrate the improved repellency, stain release, and soil resistance achieved using the multi-layer floorcovering application procedure wherein a repellent agent is applied in the first chemical layer. It is also believed that the step of steaming significantly improves the fluorochemical penetration into the center of the yarn bundle and to the bottom of the carpet yarn bundle. Thus, the combination of layering the chemicals in a specific arrangement and the step of steaming the floorcovering article significantly improves the water and oil repellency, stain release, and soil resistance of the treated floorcovering articles. This combination also significantly improves the wear durability and cleaning durability of the fluorochemical finish which results in extended lifetime performance of the floorcovering article.

Accordingly, the treated textile substrate of the present invention has many applicable end-uses. For example, the treated textile substrate may be ideally suited for use in upholstery applications such as for automotive upholstery, commercial upholstery, and residential upholstery. Other desirable end-uses include treated floorcovering articles (such as carpets and rugs) and outdoor fabrics (such as automobile convertible top fabrics, outdoor furniture fabrics and coverings, awnings, boat covers, and grill covers). It is also contemplated that the treated textile substrate may be incorporated into articles of apparel such as outerwear (e.g., rainwear), workwear (e.g., uniforms), sportswear, activewear, and fashion apparel (e.g., shirts, pants, and other garments). It may be ideal for use in drapery articles, vertical blinds, napery articles (e.g., table linens and napkins), textile barriers, medical textiles, and any other article wherein it is desirable to manufacture a substrate having improved water and oil repellency, stain release, and soil resistance characteristics.

These and other modifications and variations to the present invention may be practiced by those of ordinary skill in the art, without departing from the spirit and scope of the present invention. Furthermore, those of ordinary skill in the art will appreciate that the foregoing description is by way of example only, and is not intended to limit the scope of the invention described in the appended claims.

We claim:

1. A method for imparting improved durable repellency and stain release to a textile substrate, said method comprising the steps of:

a. Providing a textile substrate;

b. Applying a first chemical layer to at least one surface of the textile substrate, wherein said first chemical layer consists of a fluorinated repellent agent and a hydrophobic crosslinking agent;

c. Applying a second chemical layer to the first chemical layer, wherein said second chemical layer comprises a fluorinated stain release agent, a particulate component and a hydrophobic crosslinking agent; and d. Heating the treated textile substrate to remove substantially all of the excess liquid from the treated textile substrate.

2. The method of claim 1, wherein the first chemical layer of step "b" is applied to both surfaces of the textile substrate.

3. The method of claim 1, wherein application of the first chemical layer and the second chemical layer is achieved by spraying.

4. The method of claim 1, wherein application of the first chemical layer and the second chemical layer is achieved by padding.

5. The method of claim 1, wherein application of the first chemical layer and the second chemical layer is achieved by foaming.

6. The method of claim 1, wherein the first chemical layer is adjusted to a pH of 2.2+/−0.2 prior to application to the textile substrate.

7. The method of claim 1, wherein the textile substrate is exposed to a steaming process between application steps "b" and "c".

8. The method of claim 1, wherein said heating step "d" is achieved by dry heat from a tenter frame.

9. The method of claim 1, wherein said heating step "d" occurs for between about 0.5 and 10 minutes.

10. The method of claim 1, wherein said heating step "d" occurs at a temperature between about 300 and 380 degrees F.

11. The method of claim 1, wherein the second chemical layer further includes an antimicrobial agent.

12. The method of claim 1, wherein the second chemical layer further includes a coupling agent.

13. The product of the method of claim 1.

14. A method for imparting improved durable repellency and stain release to a floorcovering article, said method comprising the steps of:

a. Providing a floorcovering article;

b. Applying a first chemical layer to the floorcovering article, wherein said first chemical layer consists of a fluorinated repellent agent and a stainblocking agent;

c. Steaming the floorcovering article;

d. Applying a second chemical layer to the first chemical layer, wherein said second chemical layer consists of a fluorinated repellent agent, a fluorinated stain release agent, and a particulate component; and e. Heating the treated floorcovering article to remove substantially all of the excess liquid from the treated floorcovering article.

15. The method of claim 14, wherein application of the first chemical layer and the second chemical layer is achieved by spraying.

16. The method of claim 14, wherein application of the first chemical layer and the second chemical layer is achieved by padding.

17. The method of claim 14, wherein application of the first chemical layer and the second chemical layer is achieved by foaming.

18. The method of claim 14, wherein the first chemical layer is adjusted to a pH of 2.2+/−0.2 prior to application to the textile substrate.

19. The method of claim 14, wherein said heating step "e" is achieved by dry heat from a tenter frame.

20. The method of claim 14, wherein said heating step "e" occurs for between about 0.5 and 10 minutes.

21. The method of claim 14, wherein said heating step "e" occurs at a temperature between about 300 and about 380 degrees F.

22. The product of the method of claim 14.

* * * * *